United States Patent [19]

Raaf et al.

[11] 4,152,806

[45] May 8, 1979

[54] TOOTHBRUSH

[75] Inventors: Helmut Raaf, Bad Schwalbach; Oskar Heumann, Wiesbaden-Klarenthal, both of Fed. Rep. of Germany

[73] Assignee: Blendax-Werke R. Schneider GmbH & Co., Mainz, Fed. Rep. of Germany

[21] Appl. No.: 904,275

[22] Filed: May 9, 1978

[30] Foreign Application Priority Data

May 12, 1977 [DE] Fed. Rep. of Germany ..... 2721352

[51] Int. Cl.[2] ..... A46B 15/00

[52] U.S. Cl. ..... 15/169

[58] Field of Search ..... 15/168–170, 15/184, 160; 132/119–123

[56] References Cited

U.S. PATENT DOCUMENTS

| | | | |
|---|---|---|---|
| 3,082,457 | 3/1963 | Lucibello et al. | 15/167 |
| 3,172,139 | 3/1965 | Wire | 132/119 |

FOREIGN PATENT DOCUMENTS

| | | | |
|---|---|---|---|
| 647429 | 10/1962 | Italy | 15/169 |

*Primary Examiner*—Peter Feldman

*Attorney, Agent, or Firm*—Connolly and Hutz

[57] ABSTRACT

A toothbrush with means for adjustment of the bristle length including a moveable slotted or perforated plate arranged over the bristle holder and with bristles passing through the slots or perforations said plate being movable up and down the bristle length by means of a slide mechanism or a screw connection.

4 Claims, 5 Drawing Figures

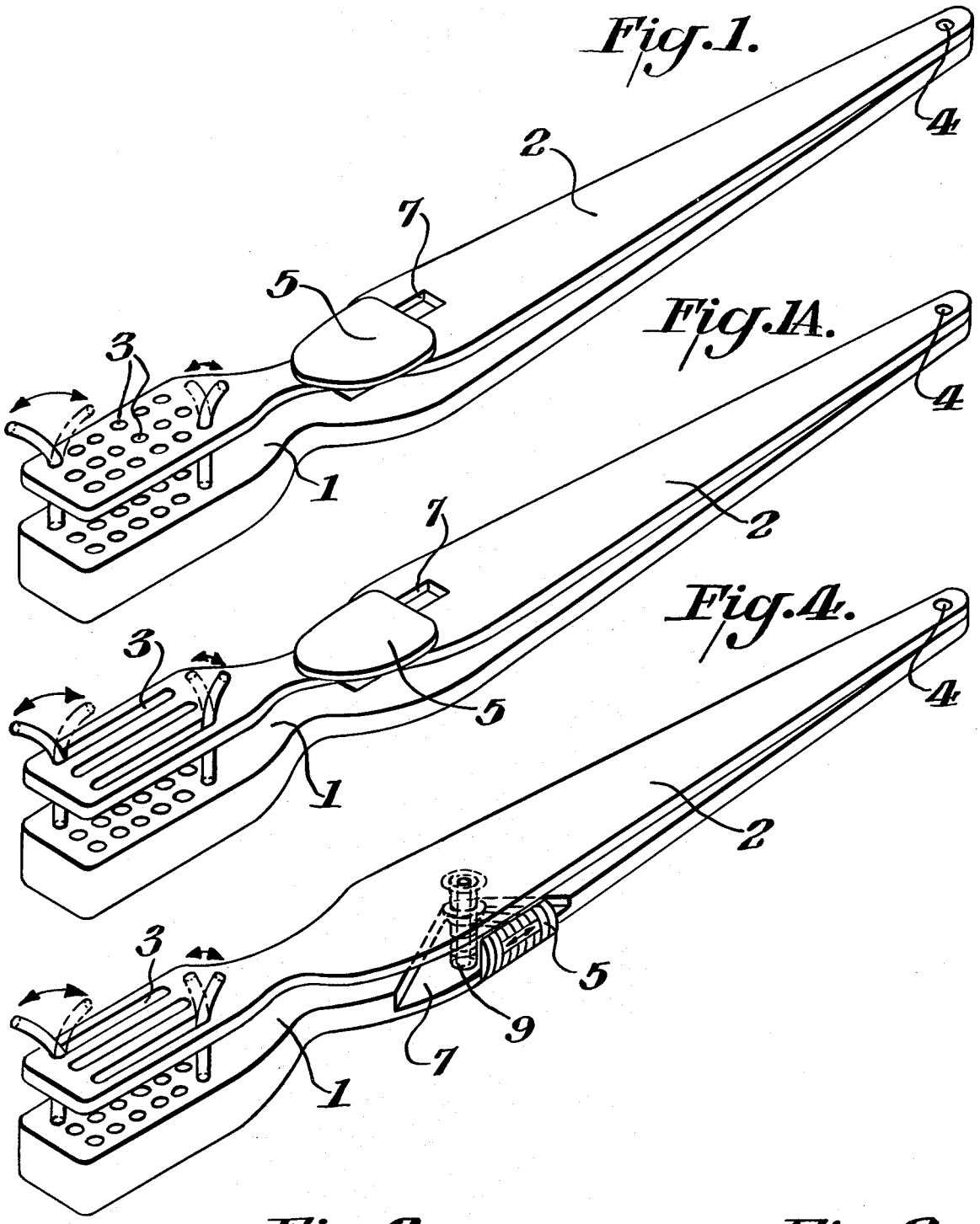
Fig.1.
Fig.1A.
Fig.4.
1
2
3
4
5
7
9
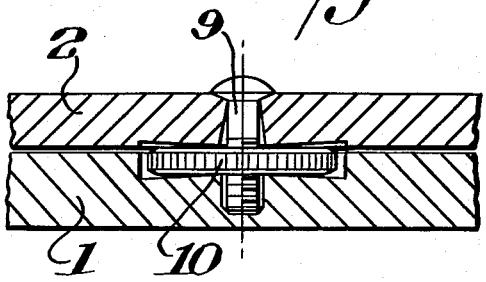
Fig.3.
2
9
1
10
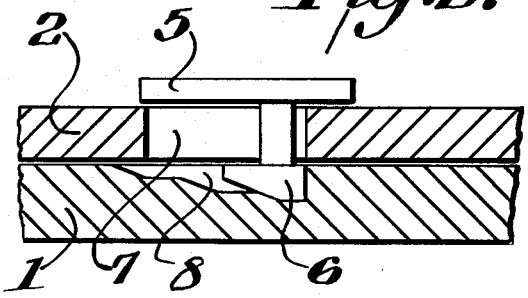
Fig.2.
2
5
1
7
8
6

TOOTHBRUSH

The current invention relates to a toothbrush whose hardness may be varied by the adjustment of the operative bristle length.

There has existed for a long time the need for toothbrushes whose bristle hardness may be variably adjusted by the user. This is desirable in order to be able to impart the suitable and the required intensity to the cleaning procedure in accordance with the condition of the teeth and the gums. The hardness and thus the cleaning power of the bristles is known to be directly correlated to their length, so that it may be controlled directly by a variable length adjustment of the bristles.

Brushes whose bristle length may be varied are already known; as actual prior art, DT-OS No. 2 107 900 should be taken into consideration. This publication discloses a hardness-adjustable brush, which consists of a brush plate, a perforated plate, and a cover, the perforated plate being adjustably arranged opposite the brush plate by means of a threaded pin and a nut thread interacting therewith, and the adjustment takes place by means of a control knob or the like arranged above the bristle plate, the control knob being shaped like a drive gear and covered by a cover arranged on the bristle plate.

By means of this device, a hardness adjustment of the brushes may actually be achieved by an up and down movement of the perforated plate. This known device, which in principle should also be applicable to toothbrushes yet according to its structure is apparently designed preponderantly for clothes and body scrubbing brushes, shows the drawback aggravating for toothbrushes, aside from its complicated assembly necessitating in turn a correspondingly expensive finishing, that the adjustment of the bristle length and thus of the brush hardness cannot be undertaken during the cleaning procedure per se but rather it requires an interruption thereof and a separate regulating by means of the drive gear.

In toothbrushes, however, it seems absolutely necessary that, aside from the simplicity of construction, the adjustment of the bristle length may be undertaken during the cleaning procedure per se.

It has now been found that this object may be solved in a structurally simple and satisfactory manner if a perforated plate, which is adjustable in height by means of a simple mechanism arranged between brush handle and perforated plate, is applied to a toothbrush handle of known type. The height adjustment may occur in this connection by means of a slide mechanism of a known type of construction or by means of actuating a knurled-head screw, also known per se.

The perforated plate mounted over the brush handle may be constructed in the form of a plate with individual perforations (for each individual bristle tuft), for one thing; however, a design in the form of longitudinal or transverse slots corresponding to the bristle tuft rows of the brush head is also possible and suitable.

Because of the size necessitated by the expensive configuration of the known hardness-adjustable brush, an application to toothbrushes is not possible.

The invention should be explained in more detail below by way of the exemplary embodiments illustrated in the drawing.

BRIEF DESCRIPTION OF THE DRAWING

FIG. 1 is a perspective view of a toothbrush with adjustable length bristles.

FIG. 1A is a perspective view of an embodiment of FIG. 1 wherein the bristles pass through an elongated slot.

FIG. 2 and FIG. 3 illustrate in fragmental cross-section the mechanism for raising and lowering the perforated plate.

FIG. 4 is a perspective view of an embodiment of FIG. 1A wherein the means for raising and lowering the perforated plate is a slide mechanism.

DETAILED DESCRIPTION

FIG. 1 shows in a perspective view a customary brush holder 1 provided with a perforated plate 2. The toothbrush illustrated in FIG. 1 (a) differs from that of FIG. 1 by the arrangement of the bristle tuft guide 3, which here is designed as longitudinal slots, while in FIG. 1 there is provided a special round, oval or even quadrangular, e.g. square, opening. By means of a mechanism actuated by the sliding head 5, the perforated or slotted plate 2 may be adjusted in its height. In place of the sliding mechanism, illustrated in more detail in FIG. 2, the height adjustment of the perforated or slotted plate 2 may also occur by means of a screw arrangement, sketched in FIG. 3. The connection of the bristle holder 1 with the slotted or perforated plate 2 takes place suitably by means of a press stud 4 mounted at the end of the toothbrush handle.

FIG. 2 renders in fragmental cross-section the sliding mechanism by means of which the height adjustment may be carried out. By the actuation of the sliding head 5, its bottom part 6 is pushed in the direction of recess 7 in the perforated or slotted plate 1 and of the graduated recess 8 in the bristle holder 1 where it is locked according to the desired height adjustment.

Alternatively, in accordance with FIG. 3, the height adjustment may also take place by a screw connection 9, arranged between bristle holder 1 and slotted and perforated plate 2, by means of knurled-head nut 10 or with a non-illustrated wing nut.

FIG. 4 finally shows yet another variant of a sliding mechanism.

We claim:

1. A toothbrush having an adjustable operative bristle length comprising (a) a brush having an elongated handle and a brush head comprising bristles secured in a base, (b) a perforated plate disposed over said base with the bristles extending through the plate perforations, said plate having an elongated arm which is secured to said handle at the end opposite the perforated plate, and (c) means for raising and lower said plate along the bristle length which is disposed between said handle and said arm.

2. A toothbrush according to claim 1 wherein the means for raising and lowering said plate is a sliding wedge.

3. A toothbrush according to claim 1 wherein the means for raising and lowering said plate is a threaded screw connection and a hand operated knurled-head nut.

4. A toothbrush according to claim 1 wherein the perforated plate has elongated slots as perforations.

* * * * *